US005915309A

United States Patent [19]

Nakai et al.

[11] Patent Number: 5,915,309

[45] Date of Patent: Jun. 29, 1999

[54] FLUIDIZED BED INCINERATOR

[75] Inventors: Seiichi Nakai; Ryozo Shiji; Takeshi Matsui; Norihiro Aoki; Yoshimasa Miura; Yusuke Okada, all of Osaka, Japan

[73] Assignee: Hitachi Zosen Corporation, Osaka, Japan

[21] Appl. No.: 08/973,853

[22] PCT Filed: Apr. 21, 1997

[86] PCT No.: PCT/JP97/01376

§ 371 Date: Apr. 6, 1998

§ 102(e) Date: Apr. 6, 1998

[87] PCT Pub. No.: WO97/41390

PCT Pub. Date: Nov. 6, 1997

[30] Foreign Application Priority Data

Apr. 26, 1996 [JP] Japan ..... 8-105966

[51] Int. Cl.[6] ..... F23B 5/00; F23D 21/00

[52] U.S. Cl. ..... 110/214; 110/210; 110/245; 110/251; 110/259; 431/170

[58] Field of Search ..... 110/245, 251, 110/252, 255, 259, 263, 264, 265, 266, 203, 210, 214; 122/4 D; 431/159, 170

[56] References Cited

U.S. PATENT DOCUMENTS

| | | | |
|---|---|---|---|
| 4,279,222 | 7/1981 | Pearce | 122/4 D |
| 4,338,283 | 7/1982 | Sakamoto et al. . | |
| 4,809,620 | 3/1989 | Cosar | 110/263 |
| 4,879,958 | 11/1989 | Allen et al. | 110/245 |
| 5,365,889 | 11/1994 | Tang | 122/4 D |
| 5,401,130 | 3/1995 | Chiu et al. | 110/245 |
| 5,546,875 | 8/1996 | Selle et al. | 110/342 |
| 5,620,488 | 4/1997 | Hirayama et al. | 48/197 R |
| 5,682,827 | 11/1997 | Nagato et al. | 110/244 |

FOREIGN PATENT DOCUMENTS

| | | | |
|---|---|---|---|
| 56-30523 | 3/1981 | Japan | 110/245 |
| 61-180889 | 8/1986 | Japan | 165/104.18 |
| 61-223421 | 10/1986 | Japan | 110/245 |
| 63-73091 | 4/1988 | Japan | 165/104.16 |
| 7-83424 | 3/1995 | Japan . | |
| 1473742 | 5/1977 | United Kingdom | 110/245 |

*Primary Examiner*—Ira S. Lazarus
*Assistant Examiner*—Ljiljana V. Ciric
*Attorney, Agent, or Firm*—Reising, Ethington, Barnes, Kisselle, Learman & McCulloch PC

[57] ABSTRACT

The oblique bed wall (6) of the furnace main unit (1) is inclined in downward direction towards the ash discharge outlet (5). Oblique side walls (24R, 24L) are formed in the right and left side walls (1*c*, 1*d*) on the inlet (4) side of the furnace main unit (1), and fluidized bed material (S) blown up from the side fluid layers (RS, LS) is guided into the central fluid layer (CS). The fluidized bed material (S) is caused to circulate in succession from the central fluid layer (CS) at the inlet (4) side towards the central fluid layer (CS) at the ash discharge outlet (5) side towards side fluid layers (RS, LS) at the ash discharge outlet (5) side towards side fluid layers (RS, LS) at the inlet (4) side towards central fluid layer (CS) at the inlet (4) side, by dispersive air emitted from dispersive air pipes (21A, 21B, 25). In this way, the fluidized bed material (S) is caused to circulate in virtually a horizontal plane without partitioning walls. Slow combustion is conducted due to a slow fluid speed, particularly in the drying and pyrolyzing zone. Stable combustion is achieved, and generation of carbon monoxide and dioxin is suppressed.

2 Claims, 4 Drawing Sheets

(a)

(b)

FLUIDIZED BED INCINERATOR

TECHNICAL FIELD

The present invention relates to a fluidized bed incinerator for incinerating municipal solid waste, industrial waste, and the like, by introducing it into a fluidized bed material.

BACKGROUND ART

In Japanese Patent Application No. 5-225269 (Japanese Patent Laid-Open Application No. 7-83424), the present inventors and others proposed a fluidized bed incinerator which resolves problems arising in the rapid combustion of material for incineration introduced into a fluidized bed material consisting of a fluid medium, such as silica or the like, and unburnt waste and combusted ash.

In this fluidized bed incinerator, a pair of partitioning walls extending from the side by the inlet for material for incineration to the side by the ash discharge outlet are provided on either side of the bed surface of a combustion chamber in a furnace main unit, such that the combustion chamber is divided into three in a lateral direction, thereby separating the fluid layer into a central fluid layer and right and left side fluid layers. Emission pipes for fluidizing air are provided respectively in the base section of each fluid layer and are composed such that, by controlling the speed of the dispersive air emitted from the emission pipes in each fluid layer, the fluidized bed material circulates fluidly in succession from the central fluid layer by the inlet towards the central fluid layer by the discharge outlet towards the side fluid layers by the discharge outlet → the side fluid layers by the inlet.

According to the composition described above, stable combustion is achieved, whereby the fluid speed of material for incineration introduced into the central fluid layer by the inlet is reduced, the material combusts slowly, and moreover, the generation of carbon monoxide and dioxin can be suppressed.

However, the following problems have been observed in the an aforementioned composition for a fluidized bed incinerator.

(1) In order to raise thermal resistance and durability, the partitioning walls are water-cooled partitioning walls comprising in-built water pipes, and therefore the thickness of the partitioning walls is increased, the bed surface of the central fluid layer becomes narrower and this bed surface area cannot be used effectively. Furthermore, the structure is complex and equipment costs increase.

(2) If the height of the fluid layers changes, then the relationship between the fluidized bed material and the height of the partitioning walls will change, making it difficult to achieve stable circulation of the fluidized bed material, and therefore requiring control of the layer height and fluid speed.

(3) In order to broaden the bed surface of the central fluid layer by the inlet, in structural terms, the side fluid layers by the inlet have a narrow surface area and the outlet space at the top of the partitioning walls becomes narrow. Therefore, it is necessary to propel the fluidized bed material upwards at a high fluid speed in order that it is transmitted from the side fluid layers by the inlet to the central fluid layer by the inlet, and hence the fluid speed of the fluidized bed material cannot be reduced in this region. Consequently, there is a limit to the extent to which the fluid speed of the fluidized bed material in the central fluid layer can be reduced.

(4) Since the side fluid layers by the inlet and the central fluid layer by the inlet are covered by low, arc-shaped ceiling partitions which guide the fluidized bed material, they do not receive heat radiated from combustion of pyrolyzed gases, or the like. Therefore, thermal efficiency declines and the temperature of the central fluid layer by the inlet and the central fluid layer by the outlet is reduced excessively.

DISCLOSURE OF THE INVENTION

An object of the present invention is to provide a fluidized bed incinerator wherein partitioning walls are eliminated, whilst at the same time low-speed circulation of fluidized bed material can be achieved, the bed surface is utilized effectively and material for incineration is combusted slowly, and furthermore, the fluid layers can be raised in temperature to beneficial effect.

In order to achieve this object, the waste incinerating apparatus according to the present invention is so arranged that in a fluidized bed incinerator, a fluid medium is introduced onto the bed surface of a furnace main unit in which a combustion chamber and a freeboard space connecting thereabove are formed, and a fluid layer is formed by fluidizing the fluid medium by means of dispersive air emitted from the bed surface, characterized in that said fluidized bed incinerator comprises: an inlet for material for incineration formed in the front wall of the furnace main unit; an ash discharge outlet for material to be incinerated formed in the rear lower section of the furnace main unit; a central fluid layer, a left side fluid layer and a right side fluid layer formed by dividing the combustion chamber in three in a lateral direction; dispersive air supply means for emitting dispersive air, provided respectively in the bed surface corresponding to the central fluid layer and the left and right side fluid layers; an oblique bed wall formed in the bed surface of the furnace main unit, which is inclined in a downward direction from the inlet side towards the ash discharge outlet side; and oblique side walls formed respectively in the left and right side walls at the inlet side of the furnace main unit, which are inclined towards the center from the lower portion to the upper portion thereof, in order that fluidized bed material comprising the fluid medium and material for incineration blown up from the side fluid layers is guided to the central fluid layer; thus providing a structure whereby the fluidized bed material is caused to circulate in succession from the central fluid layer on the inlet side towards the central fluid layer on the ash discharge outlet side towards the side fluid layers on the ash discharge outlet side towards the side fluid layers on the inlet side towards the central fluid layer on the inlet side, by means of dispersive air emitted from the dispersive air supply means.

According to the composition described above, since conventional partitioning walls are eliminated, and fluidized bed material fluidized by dispersive air supply means is guided by means of an oblique bed wall and oblique side walls, causing the fluidized bed material to circulate in an approximately horizontal plane, the fluidized bed material can be caused to flow smoothly at a slow speed, the material for incineration can be combusted slowly, stable combustion can be achieved, and furthermore, the generation of carbon monoxide and dioxin can be suppressed. Moreover, since there are no partitioning walls, the bed surface of the combustion chamber can be utilized effectively. Also, since the fluid layers on the inlet side are not covered from above by low ceiling partitions, they directly receive radiated heat from combustion gases or the like and are heated effectively, thus raising the thermal efficiency of the fluid layers as a whole.

In the composition described above, the invention is also characterized in that an oblique rear wall, which is inclined in a forward direction from the lower portion to the upper portion thereof, is formed in the rear wall of the furnace main unit in order to guide fluidized bed material blown up from the fluid layers at the ash discharge outlet side in a forward direction.

According to the composition described above, since the forward flow of fluidized bed material is promoted by means of an oblique rear wall, it is possible to promote fluidization effectively in cases where the bed surface is large in a longitudinal direction.

Moreover, in the composition described above, the invention is characterized in that it comprises secondary air nozzles, provided in the furnace main unit, for blowing air for secondary combustion into the lower portion of the freeboard space, and tertiary air nozzles, provided above these secondary air nozzles, for blowing air for tertiary combustion into the freeboard space, whereby combustion gases are subjected to two-stage combustion.

According to the composition described above, reductions in CO and NOx can be achieved by means of the two-stage combustion of combustion gases.

BRIEF DESCRIPTION OF THE DRAWINGS

FIG. 5(*b*) is a planar section showing oblique bed dispersive air pipes provided in an oblique furnace wall.

DESCRIPTION OF THE EMBODIMENTS

An embodiment of the fluidized bed incinerator relating to the present invention is now described with reference to FIG. 1–FIG. 5.

Figure 1:
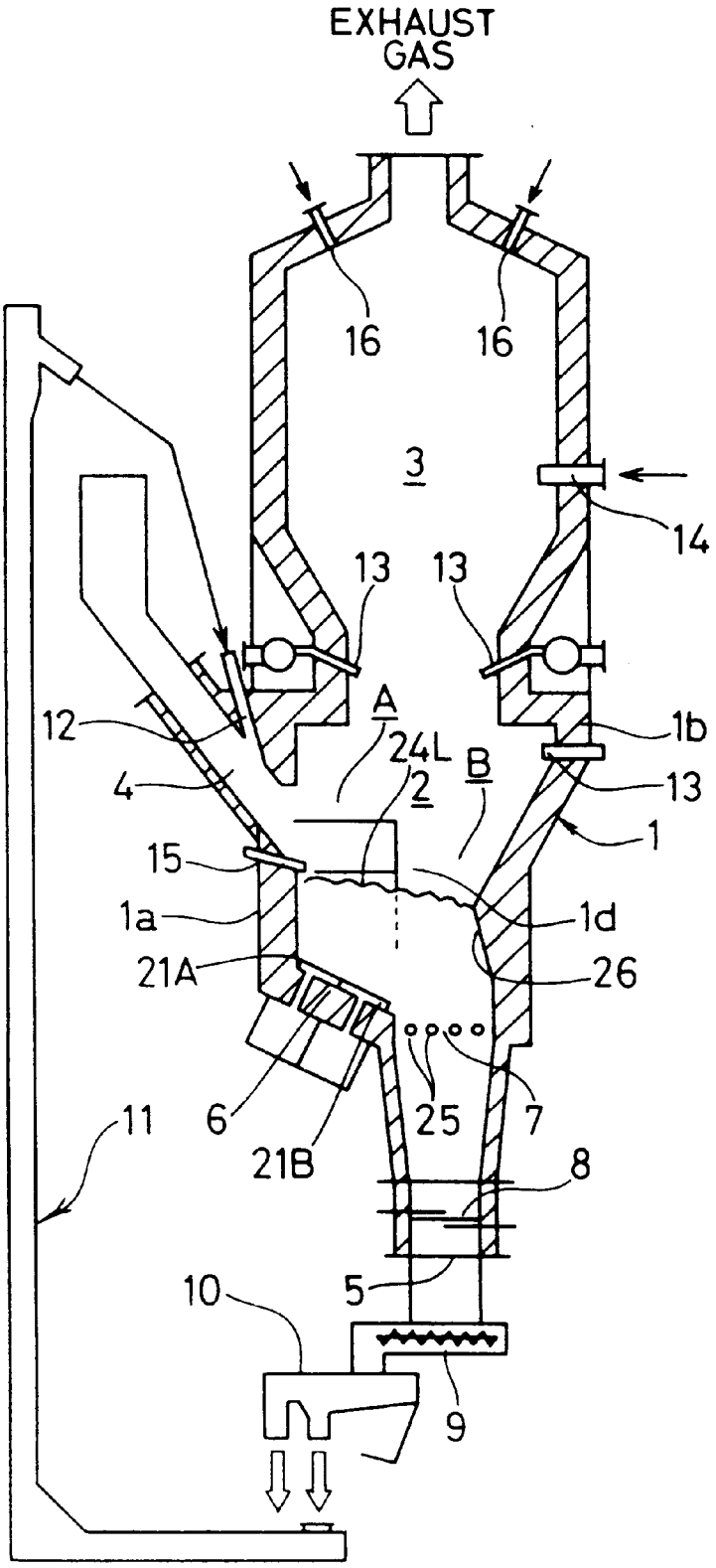
FIG. 1 is a general longitudinal section showing a fluidized bed incinerator in one embodiment of the present invention.
Figure 2:
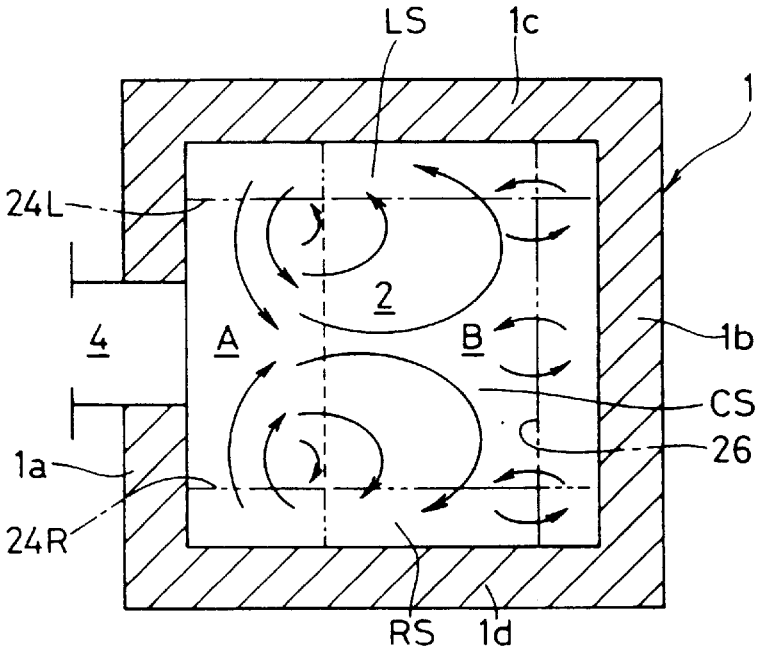
FIG. 2 is a planar section of the same fluidized bed incinerator.
Figure 3:
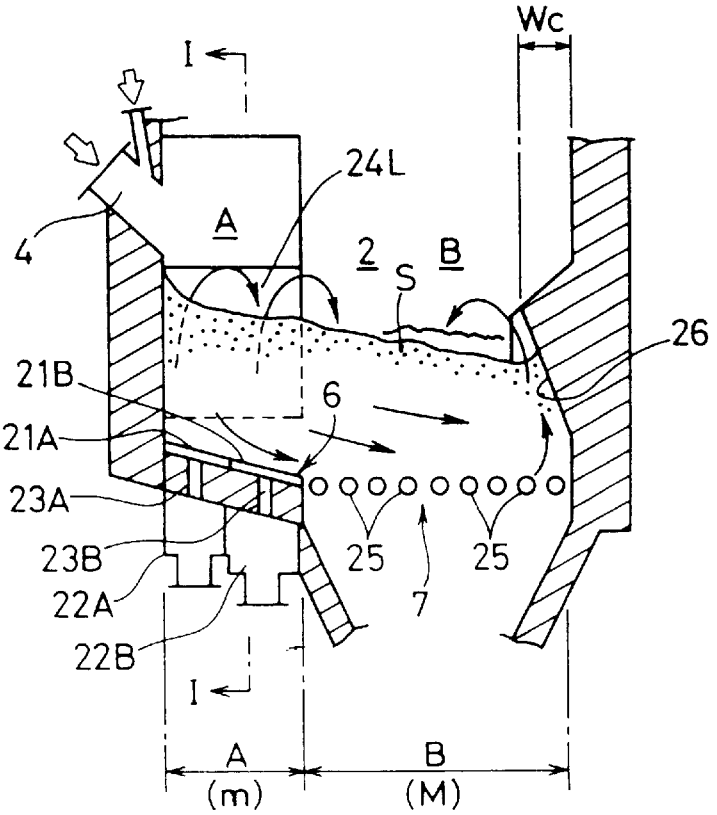
FIG. 3 is a principal side section of the same fluidized bed incinerator.

As shown in FIG. 1–FIG. 3, the furnace main unit 1 is formed with an approximately square cross-section, and comprises a combustion chamber 2 and a freeboard space 3 connecting thereabove. An inlet 4 for waste, which is the material to be incinerated, is formed in the front wall 1*a* of the furnace main unit 1, and an ash discharge outlet 5 is formed in the lower portion of the rear wall 1*b*. The base section of the combustion chamber 2 supporting the fluidized bed material S comprises an oblique bed wall 6, which forms a drying and pyrolyzing zone A (also called main head) for slow combustion where the rate of mixing and the temperature are low due to a low fluidization speed, on the inlet 4 side, and a dispersion pipe bed section 7, which forms a combustion zone B (also called main head) above the ash discharge outlet 5. The fluid layer in the drying and pyrolyzing zone A and the combustion zone B is divided into three: a central fluid layer CS, and left and right side fluid layers RS, LS, in the lateral direction of the combustion chamber 2.

A fluidized bed material discharging device 8 which is capable of discharging the silica forming the fluid medium (hereafter, called sand) and the combusted ash, in fixed quantities, is provided at the ash discharge outlet 5 and the discharged sand and combusted ash are transferred through a screen feeder 9 to a grading device 10, where the sand, combusted ash and incombustible material are separated. The sand is recycled to the inlet 5 via a sand recycling nozzle 12 by means of a sand recycling device 11.

Secondary air nozzles 13 for supplying air for secondary combustion are provided respectively in the front wall 1*a* and the rear wall 1*b* corresponding to the lower portion of the freeboard space 3. Tertiary air nozzles 14 for supplying air for tertiary combustion are provided in the rear wall 1*b* above the secondary air nozzles 13, and the combustion gases are subjected to two-stage combustion to achieve CO and NOx reductions. Numeral 15 is a furnace bed cooling water spray nozzle through which cooling water is emitted into the drying and pyrolyzing zone B from the front wall 1*a*, and 16 is a furnace head cooling water spray nozzle through which cooling water is emitted into the freeboard space 3 from above. Auxiliary burners (omitted from figures) are also provided.

As shown in FIG. 3, the lengths of the oblique bed wall 6 and the dispersion pipe furnace bed 7 in a longitudinal direction are set in the range of $m<M\leqq 1.5\times m$, where m is the length of the oblique bed wall 6 and M is the length of the dispersion pipe furnace bed 7. The oblique bed wall 6 is set at an angle of inclination, $\alpha$, of approximately 15° or above from the front wall 1*a* in a downward direction, and it is constructed such that fluidized bed material S consisting of the fluid medium, unburnt waste, combusted ash and the like, flows smoothly from the drying and pyrolyzing zone A to the combustion zone B. Moreover, front oblique bed dispersive air pipes 21A and rear oblique bed dispersive air pipes 21B, which form dispersive air supply means, are provided in adjacent positions obliquely along the surface of the oblique bed wall 6, and they are positioned at fixed intervals in a lateral direction. These front and rear oblique bed dispersive air pipes 21A, 21B are connected respectively to dispersion wind boxes 22A, 22B provided at the outer side of the base portion of the furnace main unit 1 via connecting pipes 23A, 23B, and dispersive air is supplied thereto.

Figure 5:
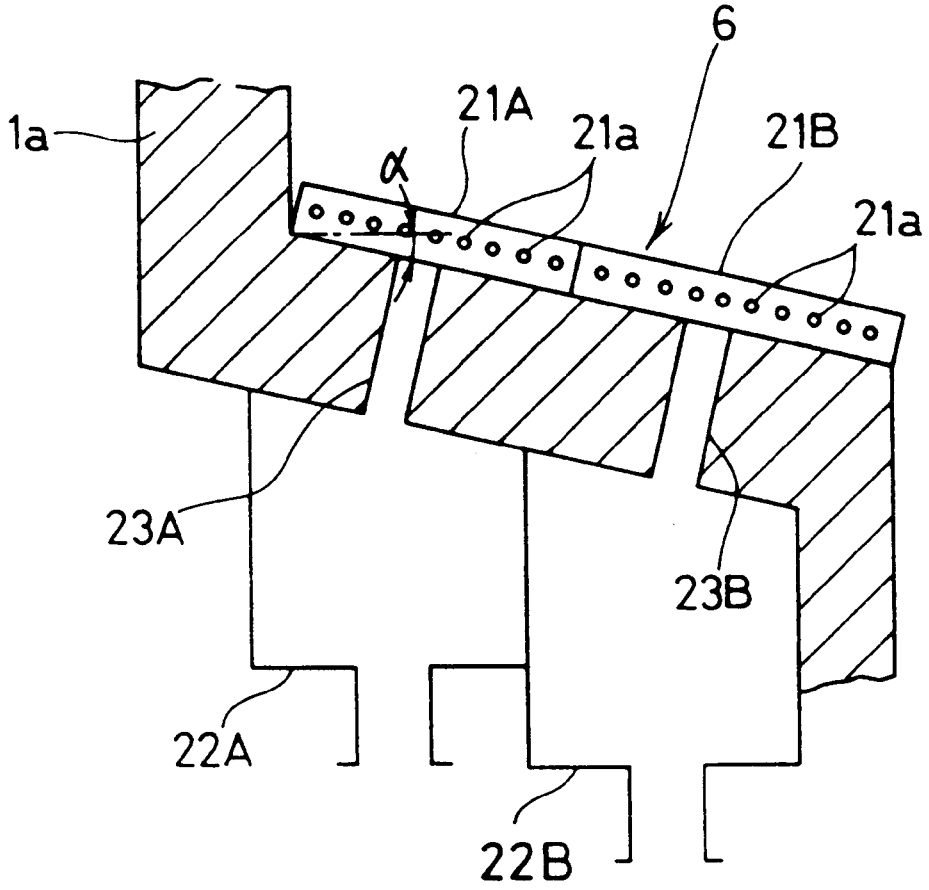
FIG. 5(*a*) is an enlarged side view showing an oblique furnace wall of the same fluidized bed incinerator.
Figure 5:
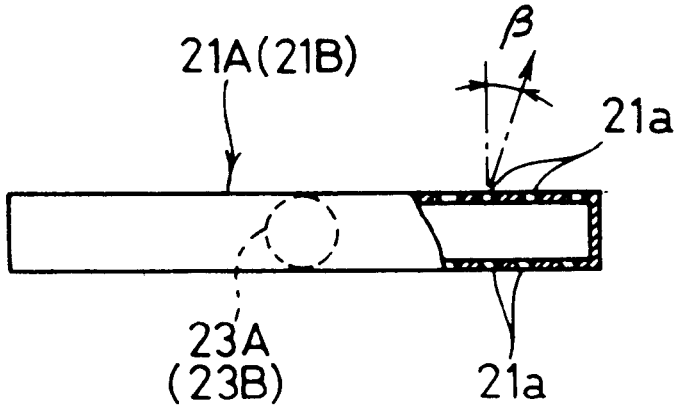

As shown in FIGS. 5(*a*) and (*b*), a plurality of dispersive air holes 21*a* are provided at uniform intervals in either side of the oblique bed dispersive air pipes 21A, 21B, at an angle of inclination, $\beta$, of 20°–40°. Dispersive air is emitted from these dispersive air holes 21*a* in a rearward and oblique downward direction towards the combustion zone B, whereby fluidized bed material S can be caused to flow from the drying and pyrolyzing zone A towards the combustion zone B. The oblique bed dispersive air pipes 21A, 21B corresponding to the central fluid layer CS and the oblique bed dispersive air pipes 21A, 21B corresponding to the right and left side fluid layers RS, LS, are constructed such that the speed of the dispersive air emitted therefrom can be controlled independently. Furthermore, since dispersive air holes 21*a* are formed in the sides of these oblique bed dispersive air pipes 21A, 21B, there are no infiltration-preventing elements projecting from the surface thereof to prevent the infiltration of fluidized bed material S into the dispersive air pipes, as in incinerators which use a dispersion plate containing dispersive air holes in the furnace bed section, and hence there is no interference to the flow of the fluidized bed material S.

Figure 4:
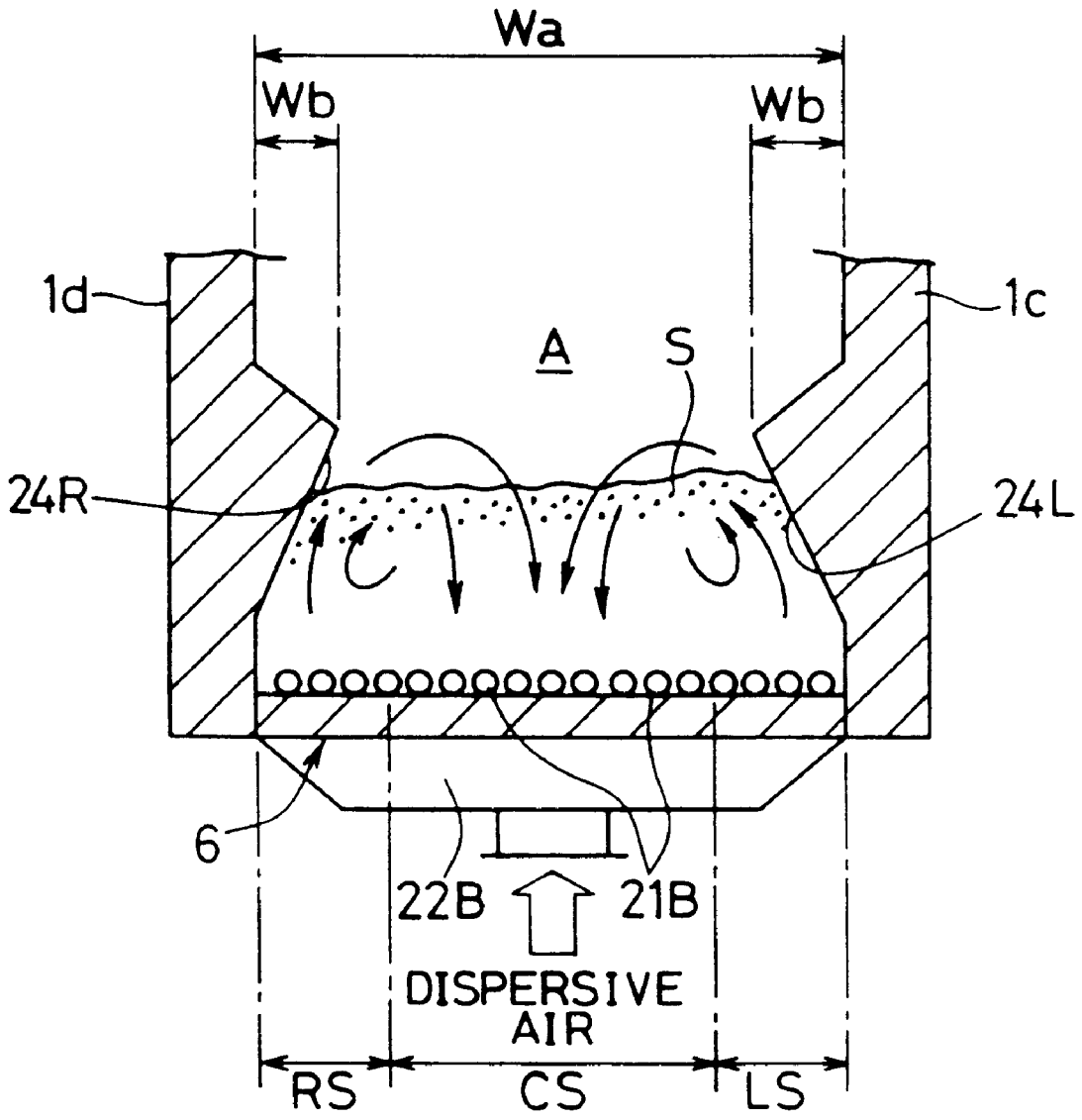
FIG. 4 is a section along I—I shown in FIG. 3.

As shown in FIG. 4, abrasion-resistant oblique side walls 24R, 24L, which are inclined towards the centre from the lower portion to the upper portion thereof and extend into the centre by a projection width Wb of ¼–⅛ of the width Wa of the combustion chamber 2, are formed respectively in the right and left side walls 1*c*, 1*d* at the drying and pyrolyzing zone A, thus providing a structure whereby fluidized bed material S blown up from the right and left side fluid layers RS, LS at the sides of the drying and pyrolyzing zone A (inlet side) is transferred towards the central fluid layer CS.

The fluidized bed material S is blown up high by means of these oblique side walls 24R, 24L, and falls down into the central fluid layer CS like rain, the waste is well confined within the fluidized bed material S, and since the movement of this fluidized bed material S pushes directly on the central fluid layer CS from the sides, churning to mix the central fluid layer CS should not be promoted. Moreover, the fire-resistant material of the oblique side walls 24R, 24L will have improved durability if the projection width Wb is smaller, since there is less abrasion when the fluidized bed material S strikes it from an oblique angle. Therefore, an appropriate design is one wherein the oblique side walls 24R, 24L have a shallow angle of inclination, within a range such that the fluid speed of the fluidized bed material S is not raised excessively.

The dispersion pipe bed section 7 forming the combustion zone B is provided with independent dispersion pipes 25, forming dispersive air supply means, which run laterally and are positioned in a horizontal plane at fixed intervals in the longitudinal direction. Hence, a structure is achieved whereby the fluidized bed material S is fluidized by means of dispersive air emitted from dispersive air holes formed in the sides thereof, whilst fluidized bed material S containing incombustible material and ash is allowed to pass.

Furthermore, an abrasion-resistant oblique rear wall 26, which is inclined towards the centre from the lower portion to the upper portion thereof and whose end projects in a forward direction by a projection width Wc virtually the same as that of the oblique side walls 24R, 24L, is formed in the rear wall 1*b* on the side by the combustion zone B. By means of this oblique rear wall 26, it is possible to cause fluidized bed material S blown up from the right and left side fluid layers RS, LS and the central fluid layer CS at the side by the combustion zone B (ash discharge outlet side) to circulate by guiding it in a forward direction. Moreover, when the combustion chamber 2 is particularly large in a longitudinal direction, fluidization of the fluidized bed material S can be promoted effectively.

In the composition described above, when waste is introduced from the inlet 4 into the combustion chamber 2, in the drying and pyrolyzing zone A, the fluidized bed material S is covered by waste, and they are mixed, heated and dried, and then pyrolyzed. The pyrolyzed gas combusts in the freeboard space 3 above, and the heat radiated from this combustion heats up the fluidized bed material S and waste in the drying and pyrolyzing zone A. The waste is then transferred with the fluidized bed material S to the combustion zone B, where it combusts. Incinerated ash from the waste passes between the independent dispersion pipes 25 in the dispersion pipe bed section 7, falls downwards and is discharged from the ash discharge outlet 5 by the fluidized bed material discharging device 8. Here, the incinerated ash and sand are separated by the grading device 10, and the sand is reintroduced into the combustion chamber 2 by means of the sand recycling device 11 and the sand recycling nozzle 12.

The combustion gases are combusted in the freeboard space 3 by means of air for secondary combustion emitted from the secondary air nozzles 13, and are then combusted completely by means of air for tertiary combustion emitted from the tertiary air nozzles 14. Levels of CO and NOx in the exhaust gases are reduced by means of this two-stage combustion.

During this incineration process, due to the action of the oblique bed wall 6, the oblique bed dispersive air pipes 21A, 21B and the oblique side walls 24R, 24L, the fluidized bed material S is caused to circulate in virtually a horizontal plane in succession from the central fluid layer CS on the inlet 4 side towards the central fluid layer CS on the ash discharge outlet 5 side towards the side fluid layers RS, LS on the ash discharge outlet side towards the side fluid layers RS, LS on the inlet 4 side towards the central fluid layer CS on the inlet 4 side, as shown by the arrows, and the combustion chamber 2 is maintained at a uniform temperature, whilst at the same time, mixing of the fluidized bed material S is promoted and effective combustion is achieved. Depending on the combustion state, in order to achieve satisfactory circulation, the speed (for example, 1.5 m/s) of the dispersive air emitted from the oblique bed dispersive air pipes 21A, 21B corresponding to the side fluid layers RS, LS should be controlled such that it is up to three times faster than the speed (for example, 0.6 m/s) of the dispersive air from the other oblique bed dispersive air pipes 21A, 21B.

According to the mode of implementation described above:

(1) Since the fluidized bed material S is circulated without partitioning walls being provided as in the prior art, the bed surface area of the combustion chamber 2 can be utilized effectively.

(2) Since the oblique side walls 24R, 24L are not heated from both sides as is the case with partitioning walls, then a standard fire-resistant material, such as castable material, is appropriate for use, without any problems concerning durability.

(3) Since the oblique side walls 24R, 24L can be formed starting from a low position, even if the layer height changes, this will have an extremely slight effect on the fluidity and circulation of fluidized bed material S, and even if the dispersive air speed is slow, sufficient upward flow of the fluidized bed material S can be achieved and the fluidized bed material S can be caused to circulate smoothly into the central fluid layer CS at the inlet 4 side.

If the central fluid layer CS is set to a slow fluid speed without horizontal circulation, then whilst slow combustion is achieved, problems arise in that the furnace bed a load decreases due to the slow combustion rate, thus requiring a larger scale furnace, and furthermore, unburnt material will be mixed into the fluidized bed material S extracted from below the furnace bed.

However, here, since the final remaining unburnt material can be combusted by being circulated to the combustion zone B by means of horizontal circulation, stable, slow combustion is established at all times in the central fluid layer CS. Therefore, the fluid speed of the fluidized bed material S in the drying and pyrolyzing zone A can be reduced, and generation of CO and dioxin can be suppressed.

(4) Since the top of the drying and pyrolyzing zone A is open and connects to the freeboard space 3 by means of the oblique side walls 24R, 24L, it is possible to heat the fluidized bed material S effectively by utilizing heat radiated from combustion in the freeboard space 3.

We claim:

1. A fluidized bed incinerator constructed such that a fluidized bed material (S) is introduced onto a bed surface of a furnace main unit (1) in which a combustion chamber (2) and a freeboard space (3) connecting above the combustion chamber are formed, and the fluidized bed material (S) is fluidized by means of dispersive air emitted from the bed surface so as to form a fluid layer, characterized in that said fluidized bed incinerator comprises:

an inlet (4) for material to be incinerated formed in the front wall (1*a*) of said furnace main unit (1);

an ash discharge outlet (5) for material to be incinerated formed in a rear lower section of the furnace main unit (1);

a central fluid layer (CS), a left side fluid layer (LS) and a right side fluid layer (RS) formed by dividing the combustion chamber into three sections in a lateral direction;

dispersive air supply means (21A, 21B, 25) for emitting dispersive air, provided respectively in the bed surface corresponding to said central fluid layer (CS) and to the left and the right side fluid layers (LS, RS);

an oblique bed wall (6) formed in the bed surface of the furnace main unit (1), the oblique bed wall being inclined in a downward direction from the inlet (4) side towards the ash discharge outlet (5) side;

and oblique side walls (24R, 24L) formed respectively in the left and right side walls (1*c*, 1*d*) at the inlet (4) side of the furnace main unit (1), the oblique side walls being inclined towards the center from the lower portion to the upper portion of said oblique side walls such that that fluidized bed material (S) blown up from the side fluid layers (LS, RS) is guided to the central fluid layer (CS);

thus providing a structure whereby the fluidized bed material (S) is caused to circulate in succession from the central fluid layer (CS) on the inlet (4) side towards the central fluid layer (CS) on the ash discharge outlet (5) side towards the side fluid layers (LS, RS) on the ash discharge outlet (5) side towards the side fluid layers (LS, RS) on the inlet (4) side towards the central fluid layer (CS) on the inlet (4) side by means of dispersive air emitted from said dispersive air supply means (21A, 21B, 25);

secondary air nozzles (13) provided in the furnace main unit (1) for blowing air for secondary combustion into the lower portion of the freeboard space (3), and tertiary air nozzles (14), provided above these secondary air nozzles (13) for blowing air for tertiary combustion into the freeboard space (3), whereby combustion gases are subjected to two-stage combustion.

2. A fluidized bed incinerator constructed such that a fluidized bed material (S) is introduced onto a bed surface of a furnace main unit (1) in which a combustion chamber (2) and a freeboard space (3) connecting above the combustion chamber are formed, and the fluidized bed material (S) is fluidized by means of dispersive air emitted from the bed surface so as to form a fluid layer characterized in that said fluidized bed incinerator comprises:

an inlet (4) for material to be incinerated formed in the front wall (1*a*) of said furnace main unit (1);

an ash discharge outlet (5) for material to be incinerated formed in a rear lower section of the furnace main unit (1);

a central fluid layer (CS), a left side fluid layer (LS) and a right side fluid layer (RS) formed by dividing the combustion chamber into three sections in a lateral direction;

dispersive air supply means (21A, 21B, 25) for emitting dispersive air, provided respectively in the bed surface corresponding to said central fluid layer (CS) and to the left and the right side fluid layers (LS, RS);

an oblique bed wall (6) formed in the bed surface of the furnace main unit (1), the oblique bed wall being inclined in a downward direction from the inlet (4) side towards the ash discharge outlet (5) side;

and oblique side walls (24R, 24L) formed respectively in the left and right side walls (1*c*, 1*d*) at the inlet (4) side of the furnace main unit (1), the oblique side walls being inclined towards the center from the lower portion to the upper portion of said oblique side walls such that that fluidized bed material (S) blown up from the side fluid layers (LS, RS) is guided to the central fluid layer (CS);

thus providing a structure whereby the fluidized bed material (S) is caused to circulate in succession from the central fluid layer (CS) on the inlet (4) side towards the central fluid layer (CS) on the ash discharge outlet (5) side towards the side fluid layers (LS, RS) on the ash discharge outlet (5) side towards the side fluid layers (LS, RS) on the inlet (4) side towards the central fluid layer (CS) on the inlet (4) side by means of dispersive air emitted from said dispersive air supply means (21A, 21B, 25), wherein an oblique rear wall (26) is inclined in a forward direction from the lower portion to the upper portion of said oblique rear wall (26) and is formed in the rear wall (1*b*) of the furnace main unit (1) so as to guide fluidized bed material (S) blown up from the fluid layers at the ash discharge outlet (5) side in a forward direction;

secondary air nozzles (13) provided in the furnace main unit (1) for blowing air for secondary combustion into the lower portion of the freeboard space (3), and tertiary air nozzles (14) provided above these secondary air nozzles (13) for blowing air for tertiary combustion into the freeboard space (3), whereby combustion gases are subjected to two-stage combustion.

* * * * *